US005426913A

United States Patent [19]

Iriarte

[11] Patent Number: 5,426,913

[45] Date of Patent: Jun. 27, 1995

[54] WRAPPING MACHINES WITH FILM

[75] Inventor: Iosu A. Iriarte, Onate, Spain

[73] Assignee: Ulma S. Coop., Ltda., Onata, Spain

[21] Appl. No.: 75,132

[22] Filed: Jun. 10, 1993

[30] Foreign Application Priority Data

Sep. 17, 1992 [ES] Spain ..... 9201865

[51] Int. Cl.[6] ..... B65B 41/00

[52] U.S. Cl. ..... 53/389.2; 53/389.1; 53/396; 53/461; 53/450

[58] Field of Search ..... 53/389.1, 389.2, 396, 53/450, 451, 461

[56] References Cited

U.S. PATENT DOCUMENTS 5,317,856 6/1994 Hanai ..... 53/389.2

*Primary Examiner*—W. Donald Bray

*Attorney, Agent, or Firm*—Helfgott & Karas

[57] ABSTRACT

The present invention relates to machines used to wrap objects or articles using a film sheet obtained from a reel. This machine uses a mechanism that adjusts to and fro movement of a connecting rod thereby limiting the length of the film to be used for wrapping the article or product. This mechanism includes a connecting rod (6) capable of to and fro movement in response to the swinging movement of a lever (1) that is set off by a cam (2). The connecting rod (6) has a lateral part (8) with a pulley wheel (9) that runs along a groove (10) within a guide (11). The guide has an articulation (12) that is jointed to the chassis (13) of the machine, in such a way that an adjustment in a swinging position of the guide (11) limits the to and fro movement of the connecting rod (6) and thus the mechanism connected to the connecting rod will carry on the drive and sectioning of the film to be used as a wrapper.

6 Claims, 2 Drawing Sheets

WRAPPING MACHINES WITH FILM

OBJECT OF THE INVENTION

The invention relates to a number of improvements to wrapping machines with film, specifically to a mechanism that adjusts and control the length of the film to be used for each type of product, wherein the mechanism is part of the wrapping machine.

The mechanism that constitutes the improvement of this invention includes a connecting rod which is provided with a to and fro movement, within predetermined limits which will provide the length of film necessary to wrap up the product or article, connected to the rod that has been provided with the to and fro movement are the mechanisms in charge of holding and driving the film sheet that comes out of a reel.

BACKGROUNDS OF THE INVENTION

To carry on the preferred operations wrapping machines with film include many mechanisms, the purpose of this invention deals with the mechanism in charge of determining the amount of film that is needed in each different process, depending of the product that is going to be wrapped up.

On the European Patent of Invention number 0092758, which priority corresponds to U.S. Pat. No. 371,892, between other parts from wrapping machines with film, it is claimed a to and fro mechanism that can be adjusted based upon the size of the product to be wrapped, using a lever jointed at one of its ends to a lower plate, while at the upper end of the lever is a jointed connecting rod with curved shape, that by one of its ends is linked to a tensor and at its other end moves through a pivot, in an arched slot found in the lower plate, being forecast that the original lever, that is jointed to the chassis of the machine, will have a lateral pivot linked to a cam which in turn produces the swinging and/or the to and fro movement of that lever, and in consequence to the swinging of the curved rod, and establishing on the end a tensor that joints the holding mechanisms for the end of the film, with the purpose of driving it and to perform, with other apropiate mechanisms, the wrapping, cutting and other operations that take place inside of the machine as a whole.

The lower plate, equipped with the curved slot on wich the lower end of the tensor moves, is jointed to a mechanism of longitudinal modification of the mention plate, and so of the tensor placement, in such a way that when the tensor changes, the top position on which the curved connecting rod moves also changes and thereby changing its to and fro movement, changing with it the distance of the sheet of the film.

It must be considered that the adjustment of the length of the curved end of the curved connecting rod will be realized when the length of the film must be changed, because it requires to wrap up a new product. In that sense, the mechanisms of the transmissions of the adjustements mentioned, will only act when the length of the film must be changed, to wrap up another new product.

DESCRIPTION OF THE INVENTION

The object of the invention, based on the mechanism mentioned before, presents as a new feature some improvements that simplify the mechanism, providing better functioning and also greater safety in the general functioning of the machine.

Specifically, the mechanism built with the improvements of this invention has a to and fro movement, with the particularity that the to and fro movement could be adjusted to give a movement to the driving mechanism of the film sheet that comes out of a reel, the driving, as explained before, is done at the moment of catching the film by its sides and pulling from it to the forecast course by the mechanism, when it reaches the end of the course, another mechanism produces the cutting of the sheet, the wrapping of the product and the thermo-sealing of the previously mentioned wrapping of film.

In utilizing the mechanism of the invention, the connecting rod to which the to and fro movement is transmited, can be moved along the slot that belongs to a intermediate part over which it articulates. In such a way that the part over which the rod could perform its to and fro movement forms a guide that is jointed at one end to the structure or general chassis of the machine and at its other end to an arm, in a way that the adjustment of the mechanism that limits the lenght of the film, is able to vertically move a lever articulately jointed to give either greater or less drive to the connecting rod in its to and fro movements transmited through the lever, linked to the general starting cam.

The thin tensor rod could be replaced with a rack that is part of the guide piece, which rack is in gear with a pinion that is activated by an engine. This has the purpose of achiveing either greater or less tabulate inclination of the guide to reach a different top for the maximum drive of the to and fro movement of the connecting rod. Obviously this solution can be changed by any other appropriate one.

In consequence, the adjusting mechanism could be activated by a cam and be jointed to a lever, to which could be also jointed a pneumatic cylinder, in a way that with such pneumatic cylinder the drive of the connecting rod could be changed, by small values (small distances and very tabulated) to allow small changes on the length of the film in the case of a film already printed. This is to obtain the adjustment on the printing centre of the article to be wrapped up, when the purpose is to wrap a different product, the engine that makes an arch to turn to the cam of the adjustment mechanism will be precisely activated, changing the position of the thin tensor rod as well as the position of the guide. This way, the variation of the position, in the swinging of the guide will change the position of the correspondent rod, in relation with its drive end of the to and fro movement, varying the length of the film sheet to wrap a new product to be packed.

It must be taken into account that, as we had already explained, the film placed into the reel can be printed, with the printout of signals on the ends of the film having the purpose of being controlled by a photocell. But it is possible that the signals will be modified or do not coincide with the photocell, and this will cause the decentration of the print on the tray of the wrapper. For that purpose it is required to appreciably modify the drive of the to and fro movement, with that purpose it has been forecast the possibility of placing a pneumatic cylinder that is jointed to the tensor thin rod at one of its ends, and to the articulation lever, by the other end, in order to move the mentioned thin rod,, in a precise way and with small distances, altering the end of the to and fro movement path of the rod that is going to work over the mechanisms that take hold of the film sheet.

Finally the fact that the lever that is activated by the cam has an arm or lateral emergency over which a rack engages in a pinnion has been forecast, which is in charge of transmiting a similar to and fro movement for the realization of the other machine operations, as for example, the bending of the film over the object to be packed.

DESCRIPTION OF THE DRAWINGS

In order to provide a fuller description and to contribute to the complete understanding of the characteristics of this invention, a set of drawings is attached to the specification which, while purely illustrative and not fully comprehensive, shows the following.

PREFERRED EMBODIMENT OF THE INVENTION

Figure 1:
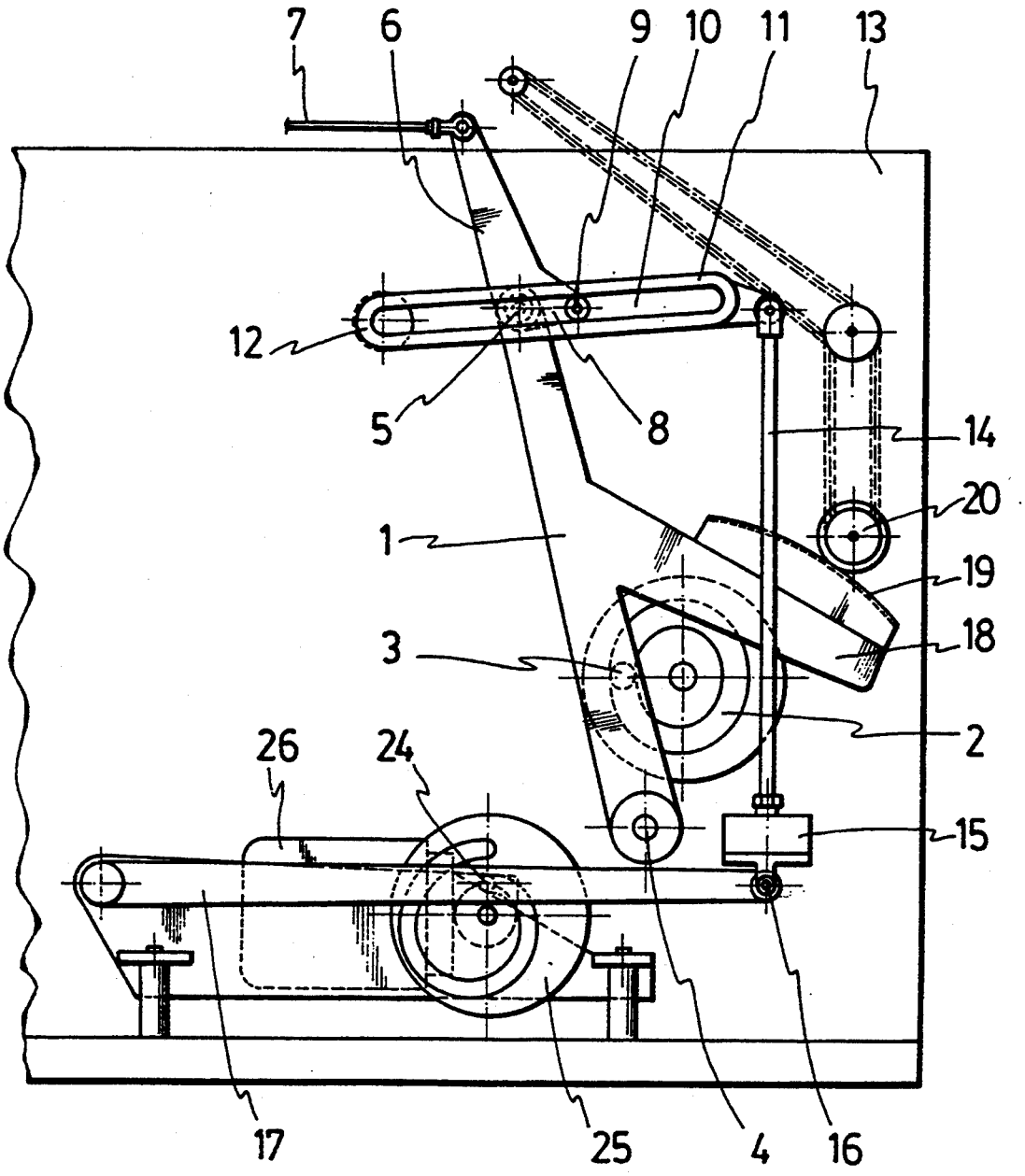
FIG. 1.—Shows a schematic representation of the side elevation view of the mechanism that constitute the improvement object of this invention.

As is shown in the figures, and specifically in FIG. 1, the mechanism that is the object of the present invention is constituted by a lever (1) that is activated by a cam (2). The mentioned lever (1) includes a lateral pivot (3) that moves within the groove of the mentioned cam (2).

The lever (1) is supported and articulated by its lower end (4), while the upper end (5) includes a rod (6) that at its free end is connected to and articulates an element (7), jointed to a mechanism, which takes hold of the film that comes from the reel and carries on the wrapping of any object or package. That rod (6), has a lateral part (8) having a pulley wheel (9), that is moveable along a guide (11), the guide (11) includes a groove (10), the pulley wheel (9) is positioned inside of a groove (10) that belongs to a part that acts as a guide (11). The guide is connected at by one of its ends (12), to the general chassis (13) of the machine, while the other end of the guide receives the articulation of the thin tensor rod (14) that at its lower end can be linked to a pneumatic cylinder (15), the pneumatic cylinder is placed over an articulated support (16) to an activating arm (17), which has a lateral bolt (24) alocated inside of a cam (25) and is activated by the turn of an engine (26).

The lever (1) includes a lateral arm (18) over which a rack (19) is mounted. This rack (19) gears a pinion (20), that, through appropriate transmission, could provide to and fro movement to the elements and mechanism intended to realize other types of operations of the packing machine, like the mechanism performing bending of the film over the object to be packed.

Figure 2:
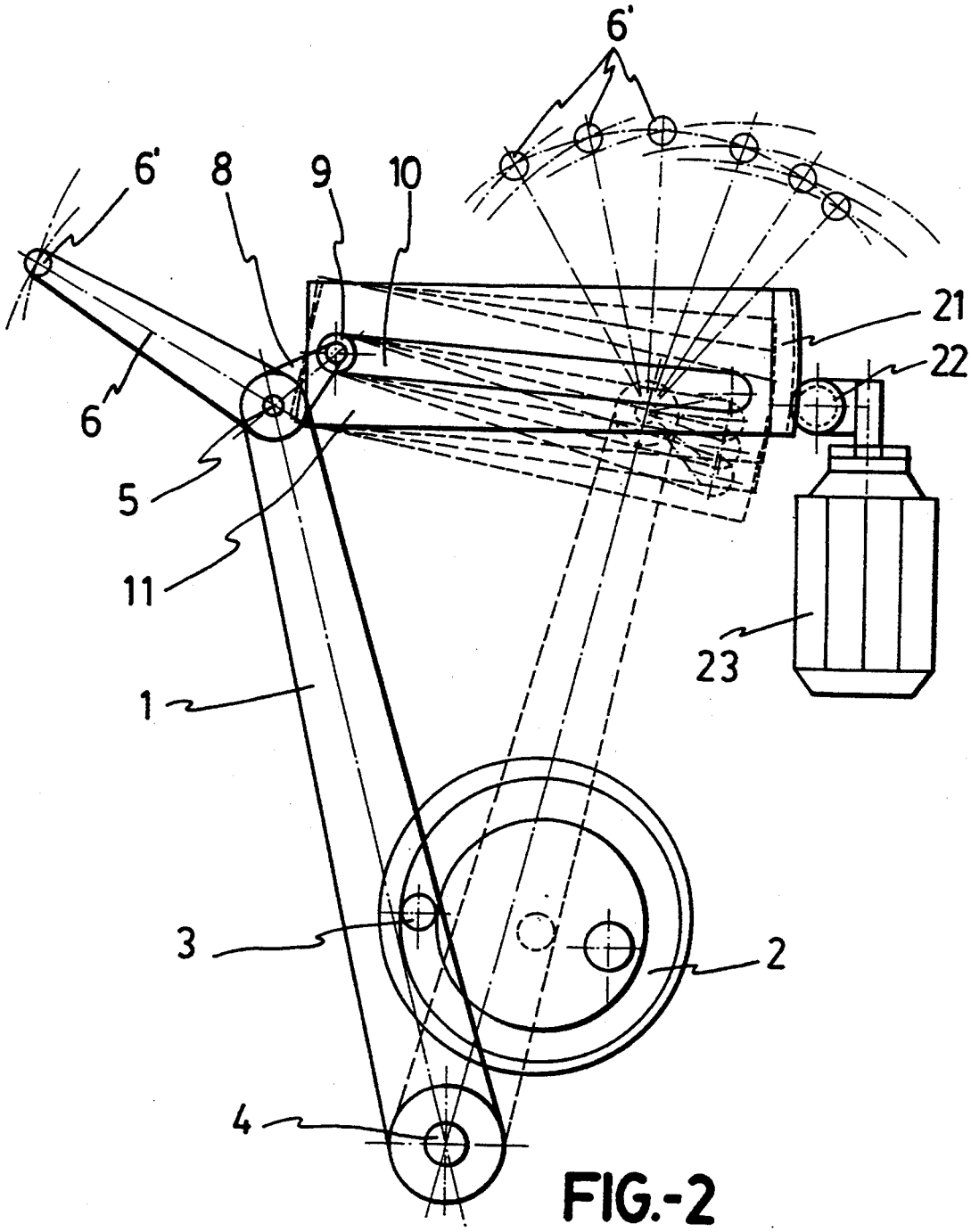
FIG. 2.—Shows one alternative of the of the mechanism presented on the prior figure.

The FIG. 2 shows an alternative form of the same mechanism, but on which the thin tensor rod (14) has been removed and in its place there is a rack (21) that forms part of an end of the guide (11), the rack gears a pinnion (22) activated by an engine (23), allowing variation, in swinging and placement of the guide (11). In any other case the purpose is that through the cam (2), and after the activation of the lever (1), to carry on the to and fro movement of the connecting rod (6). As a consequence of this movement of the lever (1) the pulley wheel (9) runs within the groove (10) of the guide (11), and depending of the possition of this last one it will obtain one top or the other of the path of that rod (6) in its to and fro movement, and so, therefore the length of the path of the mechanism jointed to the rod (6) must be one which provides the necessary length in each case, or what is the same for each product.

On FIG. 2 it can be observed how the end (6') provides articulation of the rod (6) for the element (7), along the limits of its path, depending logically of the possition during swinging of the guide (11), these positions are marked by the discountinued lines in FIG. 2.

I claim:

1. A wrapping machine including film for wrapping an article and adjusting the limits of a path of a connecting rod in a to and fro movement, the wrapping machine including a housing; a first lever having an upper end, a lower end, a lateral pivot, and an articulation; a cam linked to the first lever through the lateral pivot whereby the cam activates the first lever and the first lever is supported and articulated at its lower end to the housing of the machine; a rod having a lateral elongation and a pully wheel, linked to the upper end of the first lever, through the articulation, whereby the rod is able to perform a to and fro movement; a guide having a groove connected to the rod wherein the pully wheel is positioned within and moveable along the length of the groove, the guide being coupled at one of its ends to the housing of the machine wherein swinging of the guide determines a path of to and fro movement of the rod.

2. The wrapping machine including film, as in claim 1, further comprising a thin tensor rod connected at a first end to the guide; a second lever having means for providing a vertical swinging movement being connected to a second end of the tensor rod for providing movement to the tensor rod and thereby providing movement to the guide.

3. The wrapping machine including film, as in claim 2, further comprising a pneumatic cylinder connected to the second lever wherein adjustment of a length of the film is tabulated such that small strokes are realized by the thin tensor rod with respect to the second lever, and the pneumatic cylinder changes a length of the tensor rod based upon the movement of the guide in order to obtain a centre wherein the film is printed upon placement over an article to be wrapped.

4. The wrapping machine including film, as in claim 1 wherein the first lever further comprises a lateral arm having a first rack; and the wrapping machine further comprises movement elements; and a pinion engaged with the first rack, thereby providing a transmission activating the movement elements.

5. The wrapping machine including film, as in claim 1, further comprising a pinion statically assembled on the housing and an engine for activating the pinion; and the guide further comprises a second rack wherein the second rack engages the pinion.

6. The wrapping machine including film, as in claim 2, further comprising a pinion statically assembled on the housing and an engine for activating the pinion; and the guide further comprises a second rack wherein the second rack engages the pinion.

* * * * *